US007699003B2

(12) United States Patent
Zinell et al.

(10) Patent No.: US 7,699,003 B2
(45) Date of Patent: Apr. 20, 2010

(54) SAFETY AND ARMING UNIT FOR THE FUZE OF A PROJECTILE

(75) Inventors: Alexander Zinell, Aichhalden (DE); Reiner Hennig, Mönchweiler (DE); Rolf Kaden, Villingen-Schwenningen (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 195 days.

(21) Appl. No.: 11/858,742

(22) Filed: Sep. 20, 2007

(65) Prior Publication Data

US 2008/0210116 A1 Sep. 4, 2008

(30) Foreign Application Priority Data

Oct. 7, 2006 (DE) ..... 10 2006 047 552

(51) Int. Cl.
*F42C 15/00* (2006.01)

(52) U.S. Cl. ..... 102/221; 102/262; 102/481; 102/211

(58) Field of Classification Search ..... 102/211, 102/221, 262, 481
See application file for complete search history.

(56) References Cited

U.S. PATENT DOCUMENTS 3,088,988 A 5/1963 Menke
3,672,303 A * 6/1972 Brawn ..... 102/220
3,750,576 A * 8/1973 Balcarczyk ..... 102/205
4,089,268 A 5/1978 Jaroska et al.
2006/0060102 A1 3/2006 Boucher et al.

FOREIGN PATENT DOCUMENTS

CH 652 494 A5 1/1981
DE 31 26 289 C2 7/1981
GB 2070739 A 9/1981
GB 2103340 A 2/1983

* cited by examiner

*Primary Examiner*—James S Bergin
*Assistant Examiner*—Daniel J Troy
(74) *Attorney, Agent, or Firm*—Scully, Scott, Murphy & Presser, P.C.

(57) ABSTRACT

A safety and arming unit with a safe separation distance device (14), which acts as a function of a free-flight incident flow and temperature, for the fuze (12) of a projectile (11), which fuze is hermetically sealed from environmental influences, has, as a measurement device for the cooling, as a function of the incident flow, of a conductor through which current passes, in the heating circuit (18) of a resistant heating element (16) which is fitted flat on the fuze casing surface (17), an electronic current measurement apparatus (21) which is connected upstream of an evaluation circuit (22), in order to ram a firing circuit. Two heating elements (16, 16"), which are fed in the same way, are preferably arranged one behind the other in the incident flow direction (15), and, additionally as an environmental temperature sensor, a comparison heating element (16') which is not influenced by the incident flow (15). This results in a reliable safe separation distance, even for slow projectiles (11), without adversely affecting their aerodynamic behaviour and independently of the environmental atmosphere.

19 Claims, 1 Drawing Sheet

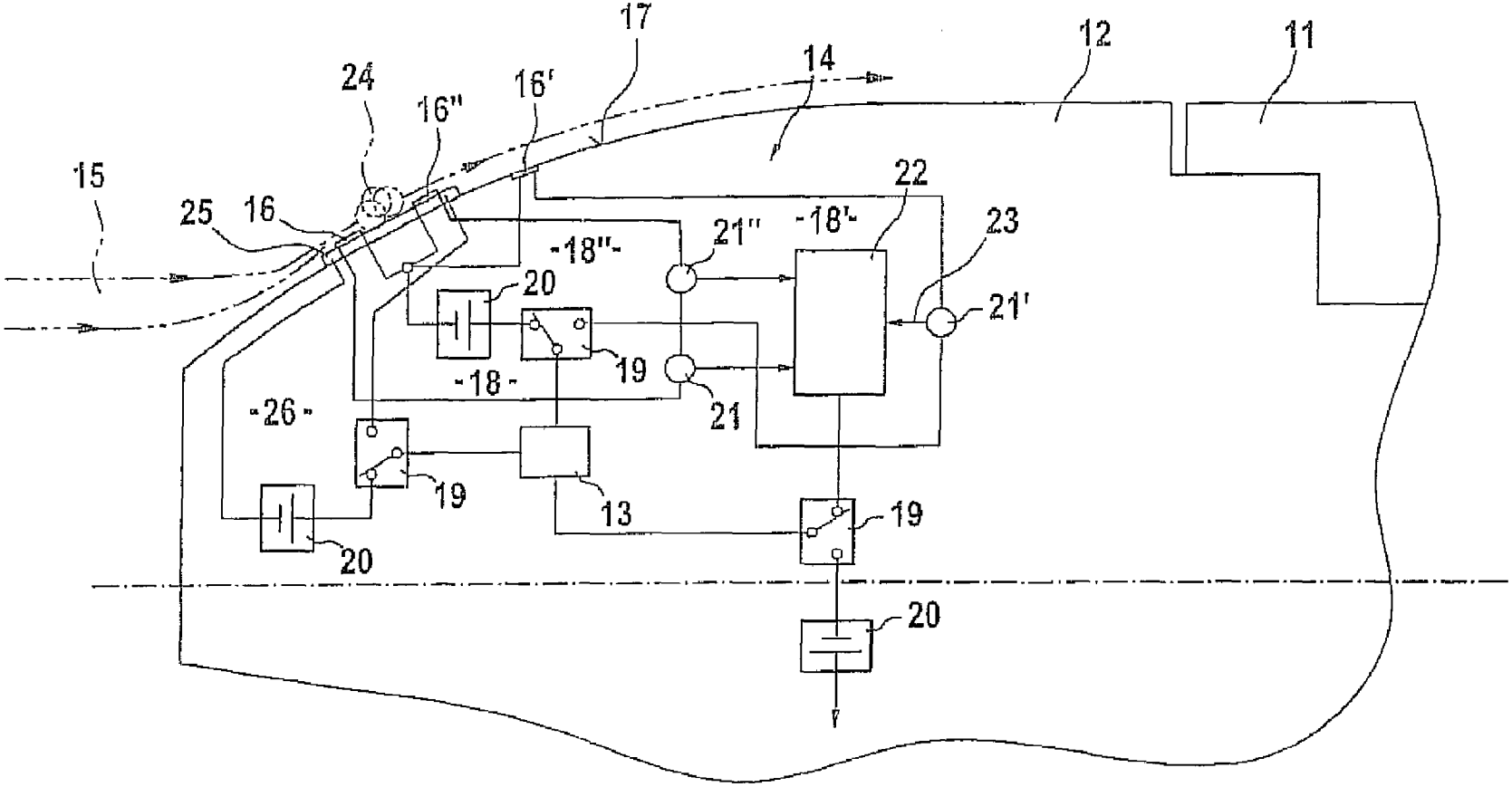
11
12
14
17
16'
16''
24
16
25
15
23
21'
22
-18'-
21''
21
19
20
-18''-
-18-
13
19
20
-26-
19
20

SAFETY AND ARMING UNIT FOR THE FUZE OF A PROJECTILE

BACKGROUND OF THE INVENTION

1. Field of the Invention

The invention relates to a safety and arming unit including a safe separation distance device, which acts as a function of an incident flow and temperature utilized for the fuze of a projectile 2. Discussion of the Prior Art A safety and arming unit of this type is known from DE 31 26 289 C for a projectile in order to ensure its second safety criterion, the safe separation distance following the launch-dependent first safety criterion. There, ram-air pressure channels, into which an unlocking element which is deformed as a function of temperature projects, run approximately parallel to the axis through the fuze between inlet openings in the end surface and outlet openings in the truncated-conical coating surface of the fuze. Once this unlocking element has been heated sufficiently intensively by the ram-air flow resulting from sufficiently long free flight, it changes its geometric shape and in consequence unlocks the second arming element, which is spring-loaded, in order to enable the projectile fuze, which will respond later, for example on striking a target.

Mechanical unlocking such as this is, however, functionally critical and generally susceptible to defects, particularly after long depot storage times. Furthermore, the compressed incident flow emerging from the fuze casing surfaces adversely affects the ballistic behaviour of the projectile. Sufficiently rapid, strong ram-air pressure heating in flow channels such as this does not occur at all, where possible, in a relatively slow projectile such as a guided missile. When a projectile such as this is operated at low altitude and in particular in a sandy, dusty environment or one in which cold moisture results in a risk of icing, there is even a risk of the flow channels becoming blocked and therefore in failure of the second arming criterion, as a result of which the projectile becomes a misfire.

Against this background, the invention is based on the technical problem of designing a safety and arming unit of this generic type for reliable operation particularly and additionally in the case of relatively slow projectiles and in critical environmental conditions, and also of providing the capability to intervene in the second arming criterion, in this context.

SUMMARY OF THE INVENTION

According to the invention, this object is achieved by the significant features specified in the main claim. According to these features, a temperature change that is dependent on the flight time is once again detected and evaluated; however, heating that is dependent on the incident flow is now no longer processed, but rather cooling, as a function of the incident flow, of electrical heating.

This opens up a wide range of operation-dependent preset options for the arming response, since, for example, the time of onset and the gradient with respect to time of the heating of a resistance heating element can be electrically controlled as a function of the first, launch-dependent arming criterion. The occurrence of the second arming criterion is evaluated in an electronic system which is not activated until its operating power supply is switched on, thus resulting in a further improvement in reliability. There is no longer any need for any moving physical parts to enable the fuze function once the safe separation distance has been reached, and in particular an electrical in-line fuze circuit with an EFI detonator can be directly armed, electrically, from the evaluation circuit for the temperature-dependent heating current flow.

The heating element which is used as a sensor for the safe separation distance may be applied, for example adhesively bonded, as a flat structure, for example having a meandering profile, of resistance wire without any mechanical intervention in the fuze, to its essentially conical outer casing surface. The laminar flow along this surface and therefore also the aerodynamic behaviour of the projectile are in consequence virtually not adversely affected at all; furthermore, the interior of the fuze remains hermetically sealed from environmental influences.

BRIEF DESCRIPTION OF THE DRAWINGS

Modification and developments of the solution according to the invention are specified in the further claims and, with regard to their advantages as well, will become evident from the following description of preferred embodiment examples which are sketched in a simplified form, and not to scale, restricted to what is essential, in the drawing. The single FIGURE of the drawing shows implementation options for the temperature-dependent second arming criterion according to the invention in the form of a partial axial longitudinal section through the fuze ogive of a projectile.

DETAILED DESCRIPTION OF THE INVENTION

A projectile 11 is fitted with a screwed-in fuze 12 in the nose. When the projectile 11 is fired, a first or handling safety device 13 responds, whose arming criterion is, for example, the acceleration or the propellant-charge gas pressure in the launch tube of a launch device, or the turning of a lanyard (not shown in the drawing). However, it must not be possible for the warhead in the projectile 11 to be fired until the safe separation distance is additionally reached, as a result of the projectile having traveled over a safe separation distance away from its launching device. The electrical safe separation distance device 14 designed according to the invention ensures that this is the case.

The operation of the safe separation distance device 14 is based on the effect of an (at least one) electrically fed resistance heating element 16 being cooled down by the incident flow 15, with this element 16 being subject to the free-flight incident flow 15, for example, in the central curvature area on the spherical/truncated-conical outer or casing surface 17 of the fuze 12.

A heating circuit 18 is closed by means of a switch 19 as a function of the response of the handling safety device 13 which has been mentioned, but preferably delayed as a function of time, with the heating element 16 thus being heated from a heating voltage source 20 to a temperature considerably above the environmental temperature. A current flow would therefore occur per se which, apart from the heating voltage, is governed by the resultant resistance of the heating element 16 which, itself, increases as the temperature rises. In fact, however, an electronic current measurement apparatus 21 located in the heating circuit 18 will measure a current flow greater than that to be expected when stationary, because the heating element 16 is cooled down by the incident flow 15. As the cooling-down process, resulting from the incident flow 15 continues (for which purpose its temperature constancy can be assumed, but is not significant), the resistance of the heating element 16 falls, that is to say the current through the measurement appliance 21 increases. This is detected in an evaluation circuit 22 downstream from the measurement appliance 21. The evaluation circuit 22 is expediently started up only with a time delay after the heating element 16 is switched on, once approximately steady-state electrical conditions have become established in the heating circuit 18. The second arming criterion is then satisfied when the current flow through the measurement appliance 21 has risen further, up to a predetermined value. The evaluation circuit 22 now arms the electrical firing circuit for the warhead in the projectile 11 (not shown in the drawing).

An unambiguous arming response is required when the cooling down of the heating element 16, caused by the incident flow and detected by the current measurement means, is as independent as possible of the temperature in the area surrounding that in which the heating element 16 is fitted, that is to say it is as independent as possible of the incident-flow temperature and the appliance temperature. This is achieved by means of compensation information 23, which is proportional to the environmental temperature, for the evaluation circuit 22. An electronic temperature sensor can additionally be used at the point where the heating element 16 is fitted, in order to obtain the compensation information 23. From the evaluation point of view, it is less complex to use an additional comparison heating element 16', which acts as a temperature sensor, is the same, and is operated and evaluated in the same way, but which in contrast is installed around the first-mentioned heating element 16 such that, as far as possible, it is not subject to any cooling from the incident flow 15. For this purpose, it can be arranged, for example, in a thermally insulated form directly under the first-mentioned heating element 16, where the metal body of the fuze 12 is at an instantaneous temperature governed by the superimposed environmental influences and which, in particular, is not only also dependent on the launch but also on the incident flow. Because of the good thermal conductivity of the metallic fuze housing, this comparison heating element 16' may, however, also be arranged within the outer casing surface 17 of the fuze 12, preferably once again sealed from the heating element 16; however, this is shown symbolically in the drawing remotely from the heating element 16. An installation in the interior of the casing surface 17 such as this assists the mounting of the sensor heating element 16, which it is desirable to fit only in a flat form, externally on the casing surface 17.

As can also be seen from the drawing, it may be expedient to arrange two heating elements 16-16", fed in the same way, at a distance from one another and one behind the other in the incident flow direction 15. This also assists the arming response, which is dependent on the temperature threshold as a function of the incident flow, of the evaluation circuit 22. This is because that heating element 16 which is located at the front with respect to the incident flow 15 in the direction of flight is cooled down, as described, by the incident flow 15 while mini-vortices 24, which occur at a distance from the heating element 16" located behind this, transfer a portion of the thermal energy dissipated from the front heating element 16 to the heating element 16" located behind this, in the flow shadow. This impedes the heating of the first heating element 16 while, at the same time, it assists the heating of the second heating element located behind it. Despite the two heating circuits 18, 18" being fed in the same way, this leads to considerably different heating currents being detected by the current measurement appliances 21, 21", that is to say it leads to difference processing in the evaluation circuit 22, with a correspondingly desirably more significant arming response for the firing circuit.

This response is improved even further in the case of indirect heating of the heating elements 16-16" which are located one behind the other in the incident flow direction 15. For this purpose, they are not arranged directly on the fuze casing surface 17 but on a type of heating mat 25 which is itself mounted on the casing surface 17 and for which a dedicated heating circuit 26, without heating-current detection, is provided. The heating produced by the heating mat 25 is transferred uniformly to both heating elements 16-16". Their heating circuits 18, 18" therefore carry the same currents, when there is virtually no temperature influence owing to the lack of any significant incident flow 15. The effect described above, of the heating of the front heating element 16 being impeded while in contrast that of the rear heating element 16" is assisted, in contrast occurs again only in the free-flight phase of the projectile 11, as a consequence of which the evaluation circuit 22 detects different currents via the measurement appliances 21, 21" in order to arm the firing circuit.

A reliable safe separation distance is therefore ensured, even in the case of slow projectiles 11 and without any adverse effect on their aerodynamic behaviour, as well as independently of the environmental atmosphere, if, according to the invention, a safety and arming unit with a safety device 14 which acts as a function of the incident flow and temperature, for a projectile fuze 12 which is hermetically sealed from environmental influences, has, as the measurement device for the incident-flow-dependent cooling of a conductor, through which current passes, in the heating circuit 18 of a resistance heating element 16, which is applied only in a flat form to the fuze casing surface 17, an electronic current measurement appliance 21 connected upstream of the evaluation circuit 22, for arming of the firing circuit; in this case, two heating elements 16, 16" which are fed in the same way are preferably provided one behind the other in the incident flow direction 15 and, possibly, also as an environmental temperature sensor, for supplying compensation information 23 to the evaluation circuit 22, a comparison heating element 16' which is not influenced by the incident flow 15.

LIST OF REFERENCE SYMBOLS

11 Projectile
12 Fuze (in front of 11)
13 Handling safety device
14 Safe separation distance device
15 Incident flow (against 12)
16 Heating element (on 17, in 16)
17 Casing surface (of 12)
18 Heating circuit (above 16)
19 Switch (in 18)
20 Heating voltage source (in 18)
21 Current measurement appliance (in 18)
22 Evaluation circuit (connected downstream from 21, 21")
23 Compensation information (from 16' to 22)
24 Mini-vortex (from 15 between 16-16")
25 Heating mat (under 16-16")
26 Heating circuit (for 25)

What is claimed is:

1. A safety and arming unit including a safe separation distance device (14), which acts as a function of a free-flight incident flow and a temperature, for a fuze (12) of a projectile (11), wherein the safe separation distance device (14) has a measurement device measuring the cooling of a conductor through which current passes, as a function of the incident flow; wherein the conductor includes at least one heating element (16) which is placed on the fuze casing surface (17) exposed to the free-flight incident flow (15); wherein at least two heating elements (16-16") are provided. located one behind the other in the direction of the incident flow (15) and having equally supplied heating circuits (18, 18"); and wherein the heating elements (16-16") are each arranged on an electrical heating mat (25) possessing an inherent heating circuit (26).

2. A safety and arming unit according to claim 1, wherein the conductor is located in said heating circuit (18) which is operable as a function of the response of a handling safety device (13).

3. A safety and arming unit according claim 1, wherein the measurement device incorporates a current measurement apparatus (21, 21"), which is located, respectively, in each said heating circuit (18, 18") and is connected to an evaluation circuit (22) to facilitate the arming of a firing circuit.

4. A safety and mining unit according claim 3, wherein compensation information (23) from a temperature sensor, which is shielded from the incident flow (15), is conveyed to the evaluation circuit (22).

5. A safety and arming unit according claim 4, wherein a comparison heating element (16') is additionally provided as said temperature sensor in a dedicated said heating circuit (18') provided for measurement purposes.

6. A safety and arming unit according to claim 5, wherein the comparison heating element (16') is arranged within the fuze casing surface (17) shielded from the incident flow.

7. A safety and arming unit including a safe separation distance device acts as a function of a free-flight incident flow and a temperature, for a fuze (12) of a projectile (11), wherein the safe separation distance device (14) has a measurement device measuring the cooling of a conductor through which current passes, as a function of the incident flow; the conductor including at least one heating element (16) which is placed on the faze casing surface (17) exposed to the free-flight incident flow (15); and at least two heating elements (16-16") being provided located one behind the other in the direction of the incident flow (15) and having equally supplied heating circuits (18, 18").

8. A safety and arming unit according to claim 7, wherein the conductor is located in the heating circuit (18) which is operable as a function of the response of a handling safety device (13).

9. A safety and arming unit according to claim 7, wherein the heating elements (16-16") are each arranged on an electrical heating mat (25) possessing an inherent heating circuit (26).

10. A safety and arming unit according to claim 7 wherein the measurement apparatus (21, 21"), which is located, respectively, in each said heating circuit (18, 18") and is connected to an evaluation circuit (22) to facilitate the aiming of a tiring circuit.

11. A safety and arming unit according to claim 10, wherein compensation information (23) from a temperature sensor, which is shielded from the incident flow (15), is conveyed to the evaluation circuit (22).

12. A safety and arming unit according to claim 11, wherein a comparison heating element (16') is additionally provided as said temperature sensor in a dedicated said heating circuit (18') provided for measurement purposes.

13. A safety and arming unit according to claim 12, wherein the comparison healing element (16') is arranged within the fuze casing surface (17) shielded from the incident flow.

14. A safety and arming unit including a safe separation distance device (14), which acts as a function of a free-flight incident flow and a temperature for a faze (12) of a projectile (11), wherein the safe separation distance device (14) has a measurement device measuring the cooling of a conductor through which current passes, as a function of the incident flow, said conductor providing at least two heating elements (16-16") which are located one behind the other in the direction of the incident flow (15) and having equally supplied heating circuits (18, 18"); and the measurement device incorporates a current measurement apparatus (21, 21"), which is located in respectively each said heating circuit (18, 18") and is connected to an evaluation circuit (22) to facilitate the arming of a fifing circuit.

15. A safety and arming unit according to claim 14, wherein the conductor is located in said heating circuit (18) which is operable as a function of the response of a handling safety device (13).

16. A safety and arming unit according to claim 14, wherein the heating elements (16-16") are each arranged on an electrical heating mat (25) possessing an inherent heating circuit (26).

17. A safety and arming unit according to claim 14, wherein compensation information (23) from a temperature sensor, which is shielded from the incident flow (15), is conveyed to the evaluation circuit (22).

18. A safety and arming unit according to claim 17, wherein a comparison heating element (16') is additionally provided as said temperature sensor in a dedicated said heating circuit (18') provided for measurement purposes.

19. A safety and arming unit according to claim 18, wherein the comparison heating element (16') is arranged within the faze casing surface (17) shielded from the incident flow.

* * * * *